US007422312B2

(12) United States Patent
Kadomatsu et al.

(10) Patent No.: US 7,422,312 B2
(45) Date of Patent: Sep. 9, 2008

(54) LIQUID EJECTION APPARATUS AND ELECTRIC FIELD APPLICATION METHOD

(75) Inventors: Tetsuzo Kadomatsu, Kanagawa (JP); Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 432 days.

(21) Appl. No.: 11/220,715

(22) Filed: Sep. 8, 2005

(65) Prior Publication Data

US 2006/0055734 A1 Mar. 16, 2006

(30) Foreign Application Priority Data

Sep. 10, 2004 (JP) ..... 2004-264136

(51) Int. Cl.
*B41J 2/06* (2006.01)

(52) U.S. Cl. ..... 347/55

(58) Field of Classification Search ..... 347/55, 347/101, 104

See application file for complete search history.

(56) References Cited

U.S. PATENT DOCUMENTS 6,508,540 B1 * 1/2003 Lean et al. ..... 347/55

FOREIGN PATENT DOCUMENTS

| | | |
|---|---|---|
| JP | 2-212149 A | 8/1990 |
| JP | 5-4342 A | 1/1993 |
| JP | 5-4343 A | 1/1993 |

* cited by examiner

*Primary Examiner*—An H Do
(74) *Attorney, Agent, or Firm*—Birch, Stewart, Kolasch & Birch, LLP

(57) ABSTRACT

The liquid ejection apparatus includes an ejection head which ejects a droplet of electrorheological liquid toward an ejection receiving medium; an electric charge application device which applies electric charge onto a surface of the droplet deposited on a first surface of the ejection receiving medium substantially simultaneously as the droplet lands on the ejection receiving medium; and an electrode which has a surface facing the electric charge application device across the ejection receiving medium and contacting with a second surface of the ejection receiving medium opposite to the first surface thereof.

14 Claims, 8 Drawing Sheets

LIQUID EJECTION APPARATUS AND ELECTRIC FIELD APPLICATION METHOD

BACKGROUND OF THE INVENTION

1. Field of the Invention

The present invention relates to a liquid ejection apparatus and an electric field application method, and more particularly to a technique of forming images and the like in a liquid ejection apparatus using an electrorheological liquid.

2. Description of the Related Art

In recent years, inkjet recording apparatuses have come into wide use as data output apparatuses for outputting images, documents, and the like. An inkjet recording apparatus is capable of forming an image (data) on a medium such as recording paper by depositing ink by driving nozzles provided in a print head in accordance with data so that the ink is ejected from the nozzles.

Demands for improved printed image quality and productivity are being made in relation to inkjet recording apparatuses. To realize higher printed image quality, the dots constituting the image must be made as small as possible, and these minute dots must be disposed at a high density. To improve productivity, the moving speed of the print head or the conveyance speed of the medium must be increased, and the scanning system, conveyance system, and ejection timing must be controlled accordingly to reduce the length of the ejection cycle.

However, when dots are disposed at high density, adjacent or surrounding dots overlap, and when ink for forming such dots is ejected in a short ejection cycle, an ink droplet lands on the medium while the ink droplet that has previously landed on the medium and not yet become fixed. As a result, the ink droplet that lands initially and the ink droplet that lands subsequently interfere with each other (landing interference), causing problems such as uneven coloring and line width variation.

In general, bleeding, dot spread, color mixing, and so on occur when using the low-viscosity ink, and these phenomena lead to great deterioration in the quality of the printed image.

There are proposed methods for suppressing deterioration in the quality of the printed image caused by landing interference, bleeding, and so on in an inkjet recording apparatus, in which an image is formed on the medium using an electrorheological ink that exhibits an electrorheological effect in which the viscosity of the ink is increased through application of an electric field. The electrorheological inks can be broadly classified into a dispersion type and a uniform type. In the dispersion type, dielectric particles are dispersed through the liquid, the particles are polarized by an electric field such that the polarized particles form bridges or chain-form clusters along the electric field direction, and these bridges and so on increase the viscosity of the ink. In the uniform type, the molecules or domains in the liquid are oriented along the electric field direction when an electric field is applied, thereby exhibiting anisotropy.

Japanese Patent Application Publication No. 2-212149 discloses an image forming method, in which an electric field is applied to a recording body possessing the electrorheological effect, thereby suppressing penetration of the recording body so that blurring and concentration deterioration are prevented.

Japanese Patent Application Publication No. 5-4342 discloses a recording apparatus, in which a recording head deposits a recording liquid having an electrorheological effect onto an intermediate transfer medium on which an electric field is formed, thereby increasing the viscosity of the recording liquid on the intermediate transfer medium so that excessive dot spread and color mixing can be prevented. When the viscosity of the recording liquid has increased through drying or the viscosity of the recording liquid has increased through the electrorheological effect thereof, the recording liquid is transferred from the intermediate transfer medium to a transfer subject medium.

Japanese Patent Application Publication No. 5-4343 discloses a recording apparatus, in which a recording head deposits a recording liquid droplet possessing the electrorheological effect onto a transfer subject medium to which an electric field is applied, thereby increasing the viscosity of the recording liquid on the transfer subject medium so that the dots formed by the recording liquid do not suffer from spread, bleeding, and color mixing. The electric field is maintained while drying of the recording liquid and penetration into the transfer subject medium progress until bleeding and color mixing no longer occur.

The electrorheological ink has a property whereby the increase in ink viscosity varies proportionally with the direction and intensity of the applied electric field. In other words, the ink exhibits reversibility such that when an electric field is applied, the viscosity of the ink appears to instantaneously increase; however, when the electric field is cut off, the viscosity returns to its original level. Therefore, the electric field generation timing and generation time (period) should be controlled in accordance with ink ejection.

In the image forming method described in Japanese Patent Application Publication No. 2-212149, a recording member on which the recording body has been deposited is passed under an electric field generated by an electrode or corona charging device. With this constitution, it is difficult to generate an electric field that is capable of producing the electrorheological effect in the recording body.

In the recording apparatuses described in Japanese Patent Application Publication Nos. 5-4342 and 5-4343, a method of charging the intermediate transfer medium or recording subject medium prior to recording is employed; however, with this method, the intensity of the electric field is weakened by atmospheric discharge and the like so that a sufficient electric field for producing the electrorheological effect in the recording liquid cannot be obtained. Moreover, unless the electric field applied to the recording liquid is maintained until the recording liquid is fixed on the medium, landing interference, bleeding of the recording liquid, and dot spread cannot be suppressed.

SUMMARY OF THE INVENTION

The present invention has been contrived in consideration of these circumstances, and it is an object thereof to provide a liquid ejection apparatus and electric field application method which can prevent landing interference, bleeding, spread, color mixing, and so on from occurring in dots formed on an ejection receiving medium using an electrorheological liquid, and can therefore form high quality images and the like on the ejection receiving medium while maintaining favorable productivity.

In order to attaint the aforementioned object, the present invention is directed to a liquid ejection apparatus, comprising: an ejection head which ejects a droplet of electrorheological liquid toward an ejection receiving medium; an electric charge application device which applies electric charge onto a surface of the droplet deposited on a first surface of the ejection receiving medium substantially simultaneously as the droplet lands on the ejection receiving medium; and an electrode which has a surface facing the electric charge application device across the ejection receiving medium and contacting with a second surface of the ejection receiving medium opposite to the first surface thereof.

According to the present invention, an electric field is formed between the surface of the liquid droplet on the ejection receiving medium and the electrode contacting the ejection receiving medium, and this electric field is applied to the liquid droplet on the ejection receiving medium at substantially the same time as the liquid droplet lands. Therefore, the electrorheological effect can be produced on the ink droplet on the ejection receiving medium reliably as soon as the ink droplet lands, and hence the viscosity of the landed liquid droplet can be raised effectively. The electric field may also be generated to produce the electrorheological effect even on a liquid droplet that lands on a conductive ejection receiving medium or an ejection receiving medium having a certain thickness.

The landing position of the liquid droplet ejected from the ejection head on the ejection receiving medium is included in the area in which the electric charge can be applied by the electric charge application device (electric charge application area), and hence the surface of the liquid droplet that lands on the ejection receiving medium can be charged at substantially the same time as the liquid droplet lands.

By continuing to apply electric charge onto the liquid droplet following landing, the electrorheological effect can be maintained with respect to the liquid droplet.

The ejection receiving medium is a medium for receiving the liquid droplets ejected by the ejection head, and may be constituted by various media, regardless of material and form, such as continuous paper, cut paper, sealing paper, a resin sheet such as an OHP sheet, film, cloth, or any medium known as a recording medium, printing medium, image forming subject medium, and so on.

The liquid includes various liquids that can be ejected through an ejection aperture (nozzle) formed in the ejection head, such as ink, resist, chemical solution, and processing liquid. The liquid may also include solid ink that is liquefied before ejection.

Examples of the ejection head include a full line ejection head in which ejection apertures are arranged over a length corresponding to the entire width of the ejection receiving medium, and a serial ejection head (shuttle scan recording head) which deposits liquid droplets onto an ejection receiving medium while scanning the ejection receiving medium in the width direction using a short head in which ejection apertures are arranged over a shorter length than the entire width of the ejection receiving medium.

Further, the full line ejection head may be constituted by short heads having a short ejection aperture array that does not cover a length corresponding to the entire width of the ejection receiving medium. In this case, the short heads are arranged in zigzag form and connected to each other to extend over a length which corresponds to the entire width of the ejection receiving medium.

The electric charge that is applied by the electric charge application device may be an electron or an ion having a positive charge or negative charge. A charge generating device for generating a charge such as an ion or electron may be provided in the electric charge application device.

Preferably, the electrode has one of a ground potential and a potential having a polarity reverse to the electric charge applied by the electric charge application device.

According to the present invention, the potential of the electrode may be set to 0V (ground), or to the reverse potential of the electric charge applied by the electric charge application device.

By setting the potential of the electrode on the opposite side of the electric charge application device to ground potential (earth) or a potential having reverse polarity to the potential of the electric charge applied by the electric charge application device, an electric field having the electrode side as a reference potential can be generated.

Preferably, the liquid ejection apparatus further comprises: a conveyance device which conveys the ejection receiving medium in a conveyance direction relatively to the ejection head, wherein the electric charge application device is arranged at least on a downstream side of the ejection head in the conveyance direction.

By providing the electric charge application device on the downstream side of the ejection head in the ejection receiving medium conveyance direction, the electric field can be applied to the liquid droplet that lands on the ejection receiving medium at substantially the same time as the liquid droplet lands, and the electrorheological effect can be produced continuously.

Preferably, the liquid ejection apparatus further comprises: a fixing acceleration device which accelerates fixing of the droplet having landed on the ejection receiving medium and is arranged on the downstream side of the ejection head in the conveyance direction, wherein the electric charge application device applies the electric charge onto the surface of the droplet across an extent from an area in which the droplet lands on the ejection receiving medium to an area in which the droplet is subjected to fixing acceleration performed by the fixing acceleration device.

According to the present invention, the electric charge is applied to the liquid droplets on the ejection receiving medium in the extent from the landing position to the area in which fixing of the liquid droplets on the ejection receiving medium is accelerated, and therefore bleeding, spread, and landing interference in the dots formed on the ejection receiving medium by the liquid droplets can be prevented.

Fixing of the liquid droplets is accelerated using a radiation application device which irradiates the liquid droplet with electromagnetic waves such as ultraviolet light, visible light, X-rays, or radiation such as electron rays, or a heating device (drying device) which uses heat or an air blast to evaporate (dry) the liquid droplet solvent, thereby hardening the liquid droplet or causing the liquid droplet to penetrate into the ejection receiving medium.

The electric charge does not have to be applied until the landed liquid droplet is completely hardened or caused to penetrate by the fixing acceleration device, and need applying only until the liquid droplet is hardened or penetrated to an extent at which color mixing or bleeding does not occur on the ejection receiving medium, or to an extent at which the image or the like is not distorted when the ejection receiving medium is handled.

Preferably, the conveyance device comprises a holding device which holds the ejection receiving medium and serves as the electrode.

According to the present invention, by having the holding device for holding the ejection receiving medium, which is provided in the conveyance device, serve also as the electrode contacting the ejection receiving medium, the apparatus can be reduced in size and increased in constitutional simplicity, enabling a reduction in cost.

The holding device may comprise a conductive member which functions as the electrode in at least the part which contacts the ejection receiving area of the ejection receiving medium. Alternatively, the holding device may be entirely constituted by a conductive member which functions as the electrode, or the conveyance device may be entirely constituted by a conductive member.

In order to attain the aforementioned object, the present invention is also directed to a liquid ejection apparatus, comprising: a plurality of ejection heads which eject droplets of electrorheological liquid toward an ejection receiving medium; a conveyance device which conveys the ejection receiving medium in a conveyance direction relatively to the ejection heads, a plurality of electric charge application devices which apply electric charge onto a surface of the droplet deposited on a first surface of the ejection receiving medium substantially simultaneously as the droplet lands on the ejection receiving medium, each of the electric charge application devices being arranged adjacently to each of the ejection heads on a downstream side of each of the ejection heads in the conveyance direction; and an electrode which has a surface facing the electric charge application devices across the ejection receiving medium and contacting with a second surface of the ejection receiving medium opposite to the first surface thereof.

When a plurality of ejection heads are provided, the electric charge application device is provided for each head, and therefore the electrorheological effect can be produced reliably on the liquid droplets ejected from each head.

When a plurality of ejection heads are provided, different types of liquid or the same type of liquid may be ejected from the respective heads. In an image forming apparatus for forming color images, for example, an ejection head may be provided for each of a plurality of colors, or ejection heads may be provided in accordance with coloring material and processing liquid.

In order to attain the aforementioned object, the present invention is also directed to an electric field application method, comprising the steps of: depositing a droplet of electrorheological liquid onto an ejection receiving medium from an ejection head; applying electric charge onto a surface of the droplet deposited on a first surface of the ejection receiving medium substantially simultaneously as the droplet lands on the ejection receiving medium; forming an electric field between an electrode provided so as to contact with a second surface of the ejection receiving medium opposite to the first surface thereof, and the electric charge on the surface of the droplet having landed on the ejection receiving medium; and generating electrorheological effect on the droplet having landed on the ejection receiving medium.

Preferably, the electric field application method further comprises the step of: accelerating fixing of the droplet having landed on the ejection receiving medium, wherein the electric charge applying step is performed across an extent from an area in which the droplet lands on the ejection receiving medium to an area in which the droplet is subjected to the fixing accelerating step.

According to the present invention, an electric field is generated between an electric charge applied by an electric charge application device onto the surface of a liquid droplet which lands on an ejection receiving medium, and an electrode facing the electric charge application device and provided in contact with the ejection receiving medium. The electric field is applied to the liquid droplet on the ejection receiving medium at substantially the same time as the liquid droplet lands, thereby producing an electrorheological effect substantially simultaneously with landing. As a result, bleeding, spreading, and landing interference can be prevented in the dot that is formed by the liquid droplet.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
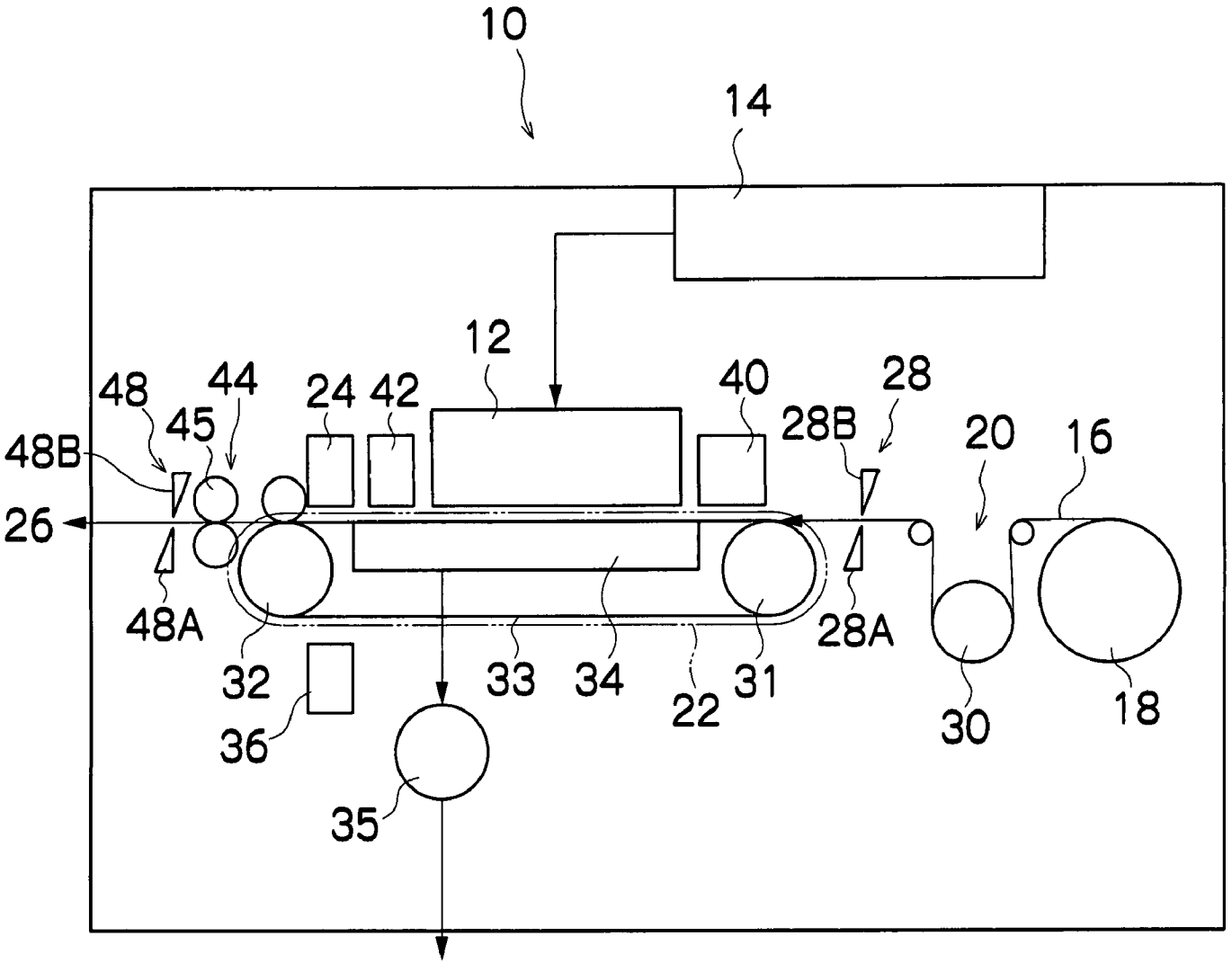
FIG. 1 is a general schematic diagram of an inkjet recording apparatus according to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of inkjet heads provided for ink colors of black (Bk), magenta (M), cyan (C) and yellow (Y), respectively; an ink storing and loading unit 14 for storing the inks to be supplied to the print heads; a paper supply unit 18 for supplying recording paper 16; a decurling unit 20 removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In this inkjet recording apparatus 10, an electrorheological ink having an electrorheological effect is used. The electrorheological ink increases in viscosity when an electric field is applied to the ink, and hence by applying an electric field to the ink droplets that have been deposited on the recording paper 16 in an inkjet recording apparatus for use with various media, interference between the ink droplets (the dots formed by the ink) on the recording paper 16, such as bleeding, spreading, and color mixing, can be prevented (suppressed).

The electrorheological ink includes some types having different constitutions, namely dispersion-type ink and uniform-type ink, and either type of electrorheological ink can be used in the inkjet recording apparatus 10. In this specification, the electrorheological ink is occasionally referred to simply as "ink".

As shown in FIG. 1, the ink storing and loading unit 14 has tanks for storing inks of the colors corresponding to the respective print heads, and each tank is connected to each print head via a tube channel (not illustrated). The ink storing and loading unit 14 also comprises a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the counterclockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed from right to left in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there might be a problem in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Next, the structure of the print unit 12 will be described in detail with reference to FIGS. 2 and 3.

Figure 2:
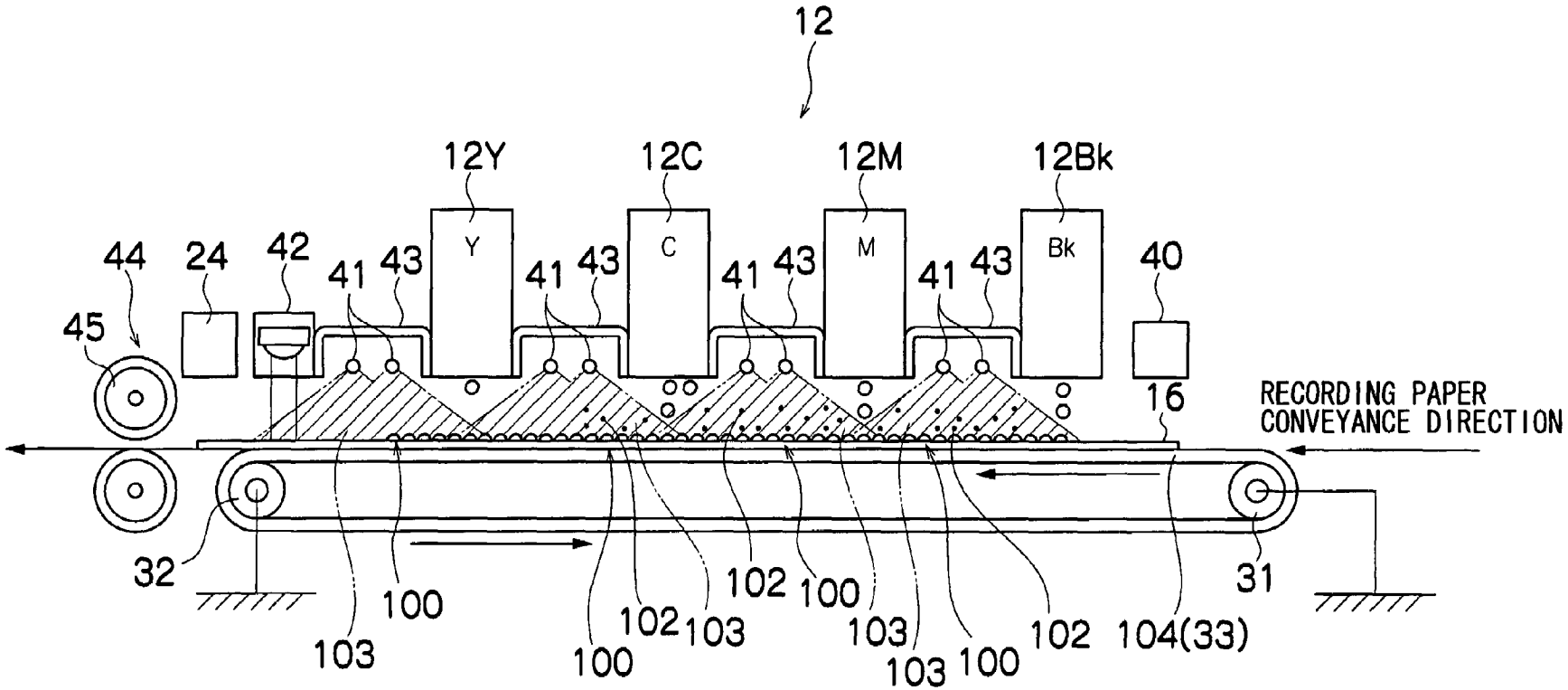
FIG. 2 is a constitutional diagram showing in detail a print unit shown in FIG. 1.

FIG. 2 is a constitutional diagram showing in detail the print unit 12 and its periphery. FIG. 3 is a plan view showing the periphery of the print unit 12 seen from above.

The print unit 12 comprises: the print heads 12Bk, 12M, 12C and 12Y corresponding to the respective colors; corona discharge generating units 41 provided to cover the entire printing area of the print heads 12Bk, 12M, 12C and 12Y, which use corona discharge to generate and apply (radiate) ions that become applied to the ink droplets ejected from the print heads 12Bk, 12M, 12C and 12Y; and an ink fixing acceleration unit 42 for fixing the ink droplets that land on the recording paper 16 to the recording paper 16.

Figure 3:
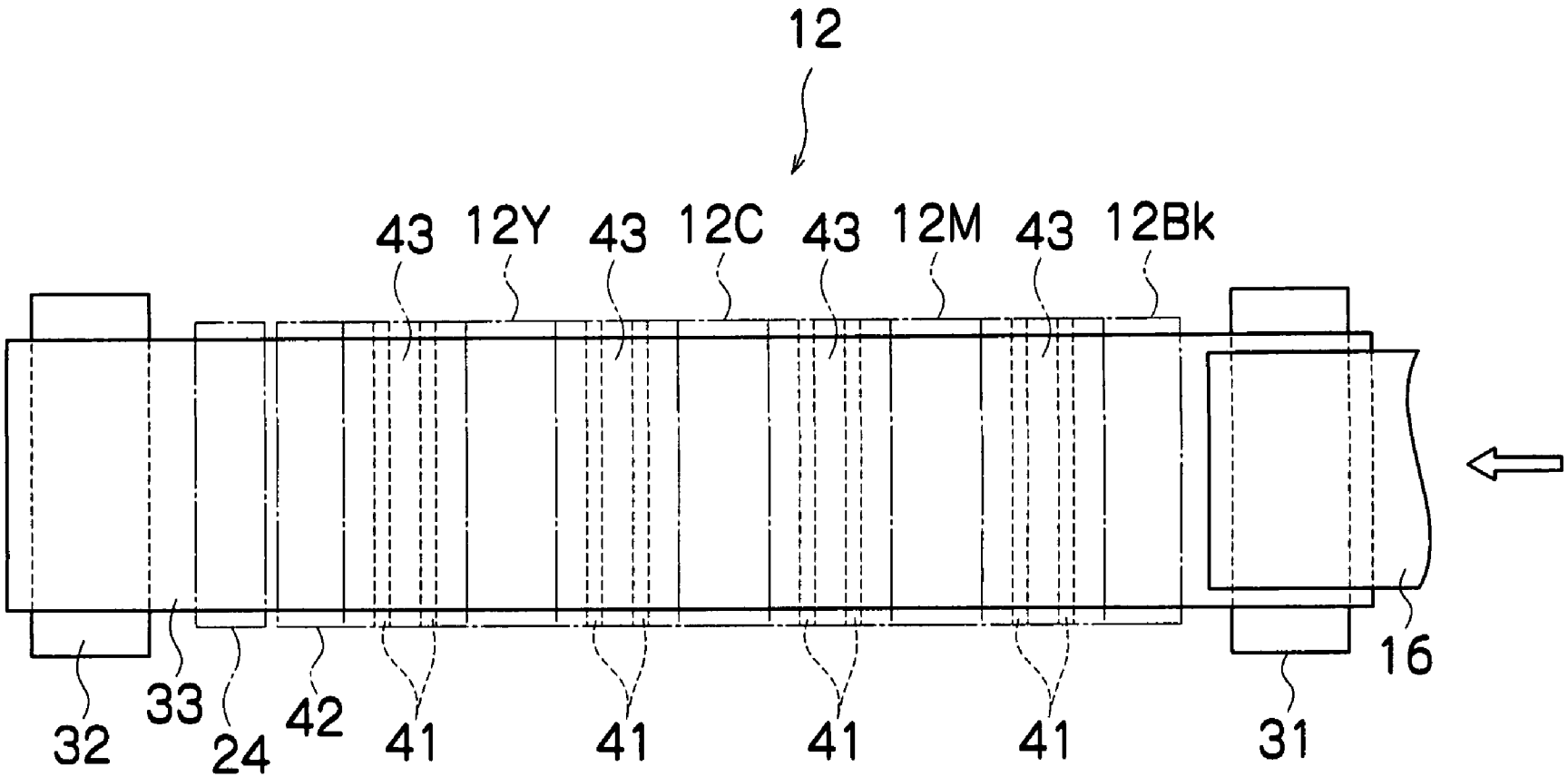
FIG. 3 is a principle plan view of the periphery of the print unit in the inkjet recording apparatus shown in FIG. 1.

Further, as shown in FIG. 3, the print unit 12 forms a so-called full line head in which line heads having a length which corresponds to the maximum paper width are disposed in a direction (the main scanning direction) perpendicular to the conveyance direction of the recording paper 16 (referred to as the recording paper conveyance direction hereafter). Each print head 12Bk, 12M, 12C, 12Y is constituted as a line head in which a plurality of nozzles are arranged over a length which exceeds at least one side of the maximum sized recording paper 16 that can be used in the inkjet recording apparatus 10.

The print heads 12Bk, 12M, 12C, 12Y corresponding to the ink colors are disposed in order of black (Bk), magenta (M), cyan (C), and yellow (Y) from the upstream side in the recording paper conveyance direction. A color image can be formed on the recording paper 16 by depositing colored inks thereon from the respective print heads 12Bk, 12M, 12C, 12Y while conveying the recording paper 16.

According to the print unit 12, in which the full line heads covering the entire paper width are provided for the respective ink colors, single-pass printing for recording an image on the entire surface of the recording paper 16 can be achieved by performing an operation to move the recording paper 16 relative to the print unit 12 in the sub-scanning direction a single time (i.e., with one sub-scan). In so doing, it is possible to achieve a higher print speed than that of a shuttle head, in which the print head performs a reciprocating movement in the main scanning direction. As a result, productivity can be improved.

Although a configuration with four standard colors, Bk, M, C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

The corona discharge generating units 41 shown in FIGS. 2 and 3 are devices for generating and radiating, through corona discharge, ions 102 (electric charge) to be applied onto the surfaces of ink droplets 100 that have been deposited on the recording paper 16, in order to generate electric fields 120 (not shown in FIG. 2, but shown in FIG. 7) applied to the ink droplet 100.

Needle electrodes, corotron, scorotron, or other device may be applied to the corona discharge generating unit 41. It is also possible to use an electron beam emitting apparatus, which emits electrons (negative charge), instead of the corona discharge generating unit 41, such that electrons, rather than the ions 102, are applied onto the surface of the ink droplet 100 on the recording paper 16.

The corona discharge generating unit 41 in the present embodiment includes a plurality of wire-form electrodes having a substantially identical length to each print head 12Bk, 12M, 12C, 12Y in the lengthwise direction of the print heads 12Bk, 12M, 12C, 12Y (i.e., a substantially parallel direction to the main scanning direction). When a voltage between several kilovolts and several tens of kilovolts is applied to these electrodes by a high voltage power supply 94 (not shown in FIG. 2, but shown in FIG. 6), the ions 102 are radiated form about the electrodes, as shown in FIG. 2. The application areas 103 of the ions 102 are indicated with the diagonal lines in FIG. 2. The position of each of the corona discharge generating units 41 is determined such that the application area 103 includes the landing positions on the recording paper 16 of the ink droplets ejected from each print head 12Bk, 12M, 12C, 12Y.

Restricting members 43 for restricting the radiating direction of the ions 102 are also provided to ensure that the ions 102 radiated from the corona discharge generating units 41 do not diffuse in the opposite direction to the recording paper 16.

A protective member for protecting the ink inside the nozzles of each print head 12Bk, 12M, 12C, 12Y from the ions 102 radiated by the corona discharge generating unit 41 is preferably provided to avoid defective ejection caused by an increase in the viscosity of the ink inside the nozzles, which occurs when the ions become applied to the ink inside the nozzles. The protective member can be a member which electrically neutralizes the ions 102 radiated from the corona discharge generating unit 41, or a member which shields the nozzles from the ions 102.

The corona discharge generating units 41 shown in FIGS. 2 and 3 are provided on the downstream sides of the print heads 12Bk, 12M, 12C and 12Y in the recording paper conveyance direction so as to cover the printing areas in which the ink droplets ejected from the print heads 12Bk, 12M, 12C and 12Y land and the ink fixing acceleration area formed by the ink fixing acceleration unit 42.

Further, as shown in FIG. 2, a planar lower electrode 104 is arranged directly beneath the recording paper 16 (on the surface opposite to the print surface). In the present embodiment, the belt 33 of the suction belt conveyance unit 22 also serves as the lower electrode 104.

By means of this constitution, the charge is applied to an ink droplet on the recording paper 16 at substantially the same time as the ink droplet lands, and by applying the charge continuously, the electrorheological effect can be maintained.

The lower electrode 104 is set at 0V (i.e., grounded) in the aspect shown in FIG. 2; however, it is also possible to set the lower electrode 104 to the reverse potential (a potential having reverse polarity) of the potential of the ions 102 on the ink droplet surfaces.

More specifically, the belt 33 serving as the lower electrode 104 uses a conductive member made of metal or the like for the surface thereof that contacts the recording paper 16 (or comprises a conductive member in the part that contacts the recording paper 16), and therefore functions not only to convey the recording paper 16, but also as a reference potential electrode, which sets the rear surface of the recording paper 16 contacting the lower electrode 104 to a reference potential of the electric field that acts on the ink droplets on the recording paper 16.

The rollers 31 and 32, around which the belt 33 is wrapped, use a conductive material for at least the surfaces which contact the belt 33. Hence, by connecting the rollers 31 and 32 at 0V, the belt 33 (i.e., the lower electrode 104) is set to the 0V potential through the rollers 31 and 32.

Both the roller 31 and the roller 32 are set to the 0V potential in the present embodiment; however, it is enough to set at least one of the roller 31 and the roller 32 to the 0V potential.

The ink fixing acceleration unit 42 is provided after the print head 12Y The ink fixing acceleration unit 42 is a device for accelerating fixing of the ink droplets that land on the recording paper 16 to the recording paper 16. The ink fixing acceleration unit 42 can be constituted by a heating fan which dries the image surface using heat or an air blast, a device which accelerates penetration of the ink solvent when a penetration-type ink is used, an ultraviolet (UV) light source which irradiates a UV curable ink with UV light, and so on.

Alternatively, a heater for hardening thermosetting ink, a device for hardening solid ink through cooling or the like, a device for hardening ink droplets through a chemical reaction, and so on may be used as the ink fixing acceleration unit 42.

The ink does not have to be completely fixed by the fixing acceleration unit 42 (a complete reaction does not have to occur) as long as the ink droplets are hardened or caused to penetrate to a sufficient degree to prevent image degradation during subsequent handling (downstream processes).

Here, the term "handling" indicates situations such as (1) friction between rollers, guides, and so on and the image surface during conveyance, (2) friction between printed objects in a stacker (a printed object collection unit), and (3) friction between the printed object and various other objects when the finished printed object is actually handled.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated through the image sensor.

The print determination unit 24 of the present embodiment is configured with at least a line sensor having rows of photoelectric transducing elements with a width that is greater than the ink-droplet ejection width (image recording width) of the heads 12Bk, 12M, 12C, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads the image printed by the print heads 12Bk, 12M, 12C, and 12Y of the respective colors, and determines the ejection performed by each head. The ejection determination includes detection of the ejection, measurement of the dot size, and measurement of the dot formation position.

A heating/pressurizing unit 44 is disposed following the print determination unit 24. The heating/pressurizing unit 44 is a device to control the glossiness of the image surface, and the image surface is pressed with a pressure roller 45 having a predetermined uneven surface shape while the image surface is heated, so as to control the surface condition and the glossiness of the image surface.

The printed matter generated in this manner is outputted from the paper output unit 26 shown in FIG. 1. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. Although not shown in FIG. 1, the paper output unit 26A for the target prints is provided with a sorter for collecting prints according to print orders.

Structure of the Head

Next, the structure of a print head will be described. The print heads 12Bk, 12M, 12C and 12Y provided for the respective ink colors have the same structure, and a reference numeral 50 is hereinafter designated to any of the print heads 12Bk, 12M, 12C and 12Y.

Figure 4A:
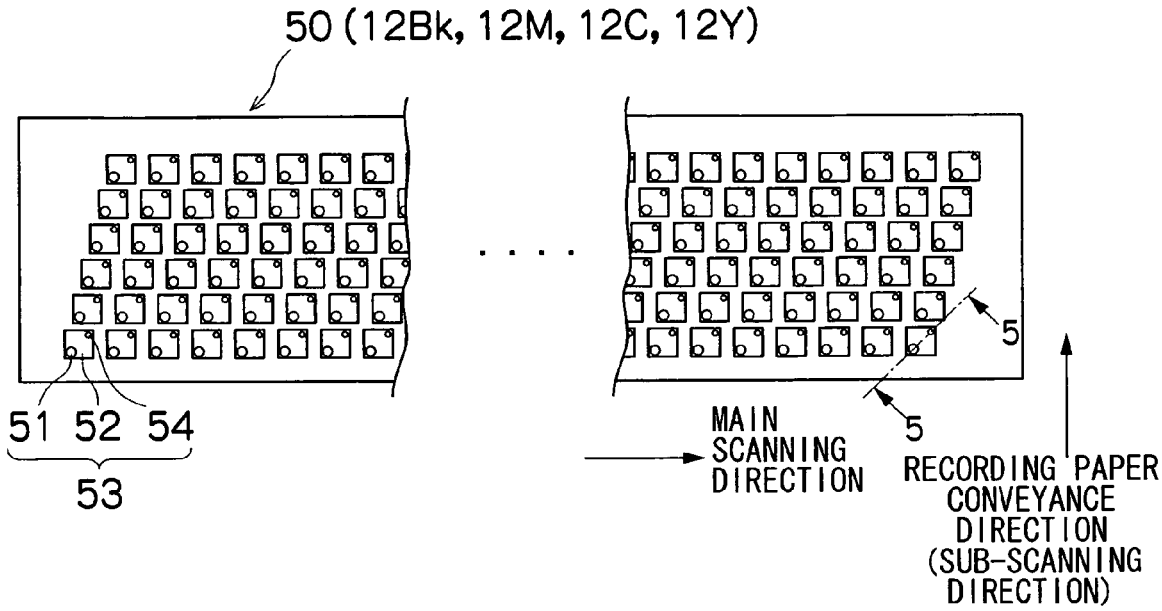
FIGS. 4A, 4B, and 4C are projected plan views showing structural examples of a print head.
Figure 4B:
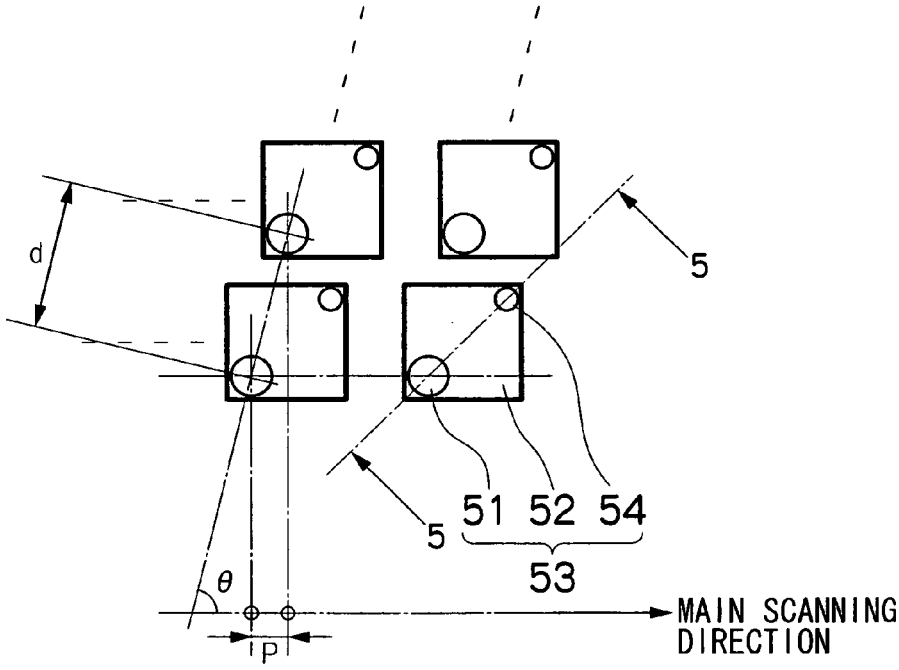

FIG. 4A is a plan view perspective diagram showing an example of the structure of a print head 50, and FIG. 4B is an enlarged diagram of a portion of same. Furthermore, FIG. 4C is a plan view perspective diagram showing a further example of the composition of a print head 50, and FIG. 5 is a cross-sectional diagram showing a three-dimensional composition of an ink chamber unit (being a cross-sectional view along line 5-5 in FIGS. 4A and 4B).

In order to achieve a high density of the dot pitch printed onto the surface of the recording medium, it is necessary to achieve a high density of the nozzle pitch in the print head 50. As shown in FIGS. 4A to 4C and FIG. 5, the print head 50 in the present embodiment has a structure in which a plurality of ink chamber units 53, each comprising nozzles 51 for ejecting ink droplets and pressure chambers 52 corresponding to the nozzles 51, are disposed in the form of a staggered matrix, and the effective nozzle pitch is thereby made small.

More specifically, as shown in FIGS. 4A and 4B, the print head 50 according to the present embodiment is a full-line head having one or more nozzle rows in which a plurality of nozzles 51 for ejecting ink are arranged along a length corresponding to the entire width of the recording medium in a direction substantially perpendicular to the conveyance direction of the recording medium.

Figure 4C:
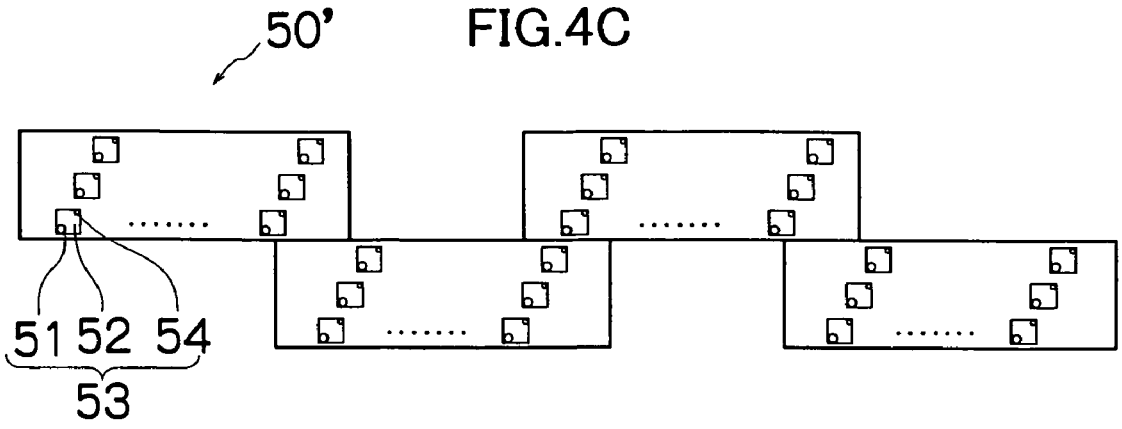
Figure 5:
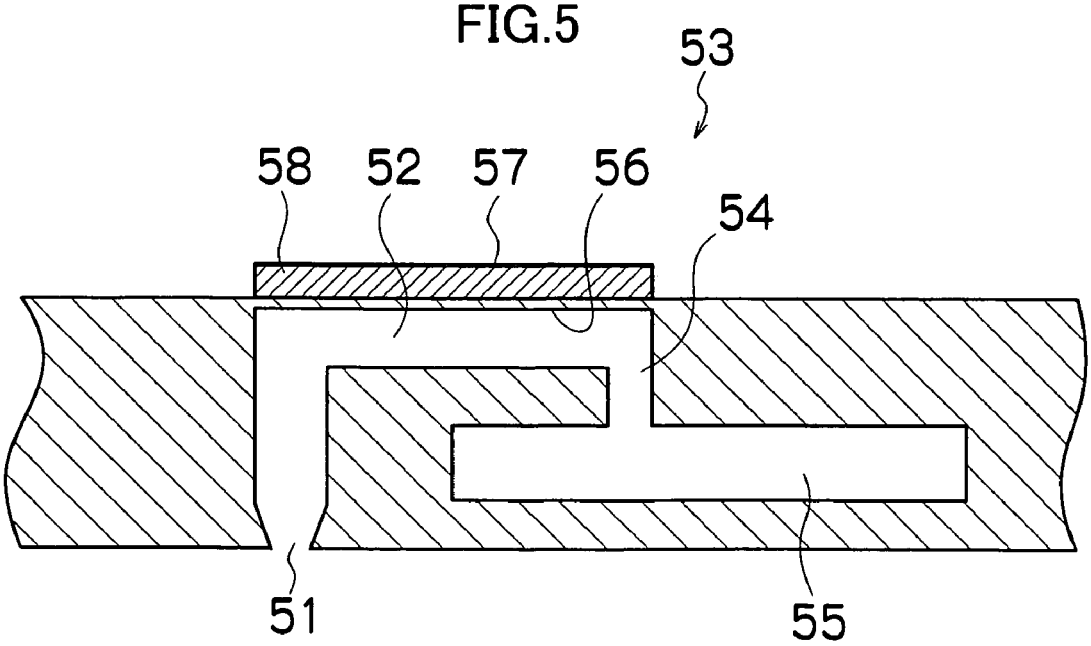
FIG. 5 is a sectional view along a cross-section 5-5 in FIGS. 4A and 4B.

Moreover, as shown in FIG. 4C, it is also possible to use respective heads 50' of nozzles arranged to a short length in a two-dimensional fashion, and to combine same in a zigzag arrangement, whereby a length corresponding to the full width of the print medium is achieved.

As shown in FIG. 5, the pressure chamber 52 provided for each nozzle 51 has a substantially square planar form, and the nozzle 51 and a supply port 54 are provided at the two corner portions on the diagonal. Each pressure chamber 52 communicates with the common flow passage 55 via its supply port 54.

An actuator 58 provided with an individual electrode 57 is bonded to a pressure plate (diaphragm) 56, which forms the ceiling of the pressure chamber 52. When a drive voltage is applied to the individual electrode 57, the actuator 58 is deformed, and the ink inside the pressure chamber 52 is thereby ejected through the nozzle 51. When ink is ejected, new ink is supplied to the pressure chamber 52 from the common flow channel 55 through the supply port 54.

As shown in FIG. 4B, a large number of the ink chamber units 53 constituted in this manner are arranged in a constant, lattice-form array pattern along a row direction in the main scanning direction and a column direction oblique to the main scanning direction at a constant angle $\theta$. By arranging the plurality of ink chamber units 53 at a constant pitch d in the direction of the angle $\theta$ relative to the main scanning direction, a pitch P of the nozzles projected so that the nozzles line up in the main scanning direction is $d \times \cos\theta$.

More specifically, the arrangement can be treated equivalently to one wherein the respective nozzles 51 are arranged in a linear fashion at uniform pitch P, in the main scanning direction. By means of this composition, it is possible to achieve a nozzle composition of high density.

Upon implementation of the present invention, the nozzle arrangement configuration is not limited to the embodiment illustrated in the drawings. For example, a single nozzle array may be disposed in the main scanning direction and a plurality of nozzles may be arranged in the sub-scanning direction.

Further, the present embodiment describes a method of applying ejection pressure to the ink inside the pressure chamber 52 through deformation of the actuator 58; however, it is also possible to employ a thermal method, in which a heater is provided to heat the ink inside the pressure chamber 52 (ink chamber), and the ink is ejected by the pressure of bubbles generated when the ink is heated.

Description of Nozzle Maintenance

Next, nozzle maintenance in the inkjet recording apparatus 10 will be described.

During printing or standby in the inkjet recording apparatus when the usage frequency of a specific nozzle 51 decreases and ink is not ejected for a certain time period or longer, the ink solvent in the vicinity of the nozzle evaporates, causing the viscosity of the ink to rise. The viscosity of the ink inside the nozzle also rises when the electrorheological effect is produced in the ink inside the nozzle 51. In these situations, ink can no longer be ejected from the nozzle 51 even when the actuator 58 is operated.

Before such a situation arises (when the ink is within a viscosity range that enables the ink to be ejected by an operation of the actuator 58), the actuator 58 is operated, so that a preliminary ejection (a purge, dry ejection, or dummy ejection) is made to eject the degraded ink (the viscous ink in the vicinity of the nozzle) toward a cap or ink receiver (not shown).

Defective ejection of each nozzle is determined on the basis of the determination result produced by the print determination unit 24 shown in FIGS. 1 to 3, and a preliminary ejection is performed on the nozzle determined to be defective.

Likewise, when bubbles become intermixed in the ink inside the print head 50 (inside the pressure chamber 52), ink can no longer be ejected from the nozzle 51 even when the actuator 58 is operated. In this case, the aforementioned cap is placed on the print head 50, the ink inside the pressure chamber 52 (the ink in which bubbles have become intermixed) is removed by suction using a suction pump (not shown), and the suction-removed ink is sent to a collection tank (not shown).

This suction operation entails the suctioning of degraded ink of which viscosity has increased (hardened) also when initially loaded into the head, or when service has started after a long period of being stopped. Note that the suction operation is performed on all of the ink in the pressure chamber 52, and hence the ink consumption increases as a result. Therefore, when the increase in the ink viscosity is small, it is preferable to perform a preliminary ejection.

Description of Control System

Figure 6:
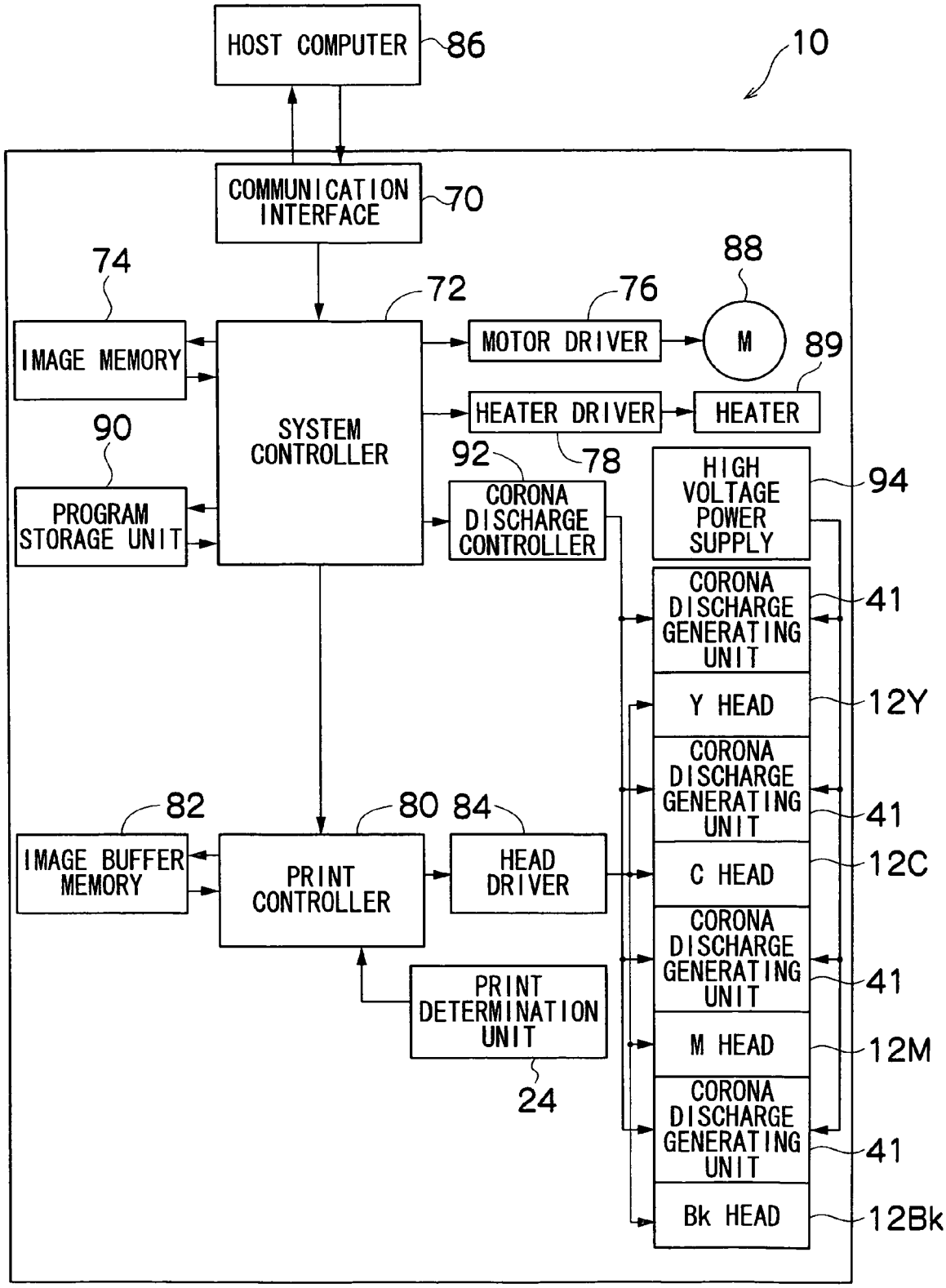
FIG. 6 is a principle block diagram showing the system constitution of the inkjet recording apparatus.

FIG. 6 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74.

The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver 76 drives the motor 88 in accordance with commands from the system controller 72. The heater driver 78 drives the heater 89 of the ink fixing acceleration unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

The head driver 84 drives the actuators 58 of the heads of the respective colors 12Bk, 12M, 12C and 12Y on the basis of print data supplied by the print controller 80. The head driver 84 can be provided with a feedback control system for maintaining constant drive conditions for the print heads.

Various control programs are stored in a program storage unit 90, and the control programs are read and executed in accordance with a command of the system controller 72. For the program storage unit 90, a semiconductor memory such as a ROM or EEPROM may be used, or a magnetic disk may be used. The program storage unit 90 may have an external interface and use a memory card or a PC card. Of course the program storage unit 90 may have a plurality of storage media of these storage media.

The program storage unit 90 may be used along with a storage device (not shown) for an operation parameter and the like.

The print determination unit 24 is a block that includes the line sensor as described above with reference to FIGS. 1 to 3, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24.

A corona discharge control unit 92 controls the corona discharge generating unit 41 in accordance with instructions from the system controller 72. The corona discharge control is performed in accordance with droplet ejection control of the print head 50 (12Bk, 12M, 12C, 12Y) so that ions are scattered onto the printing area of the print head 50 and the ink fixing area. The electric field intensity required to generate the electrorheological effect is between several kilovolts per millimeter (kV/mm) and several tens kV/mm. In the corona discharge of the present embodiment, a voltage between several kilovolts and several tens of kilovolts is supplied to the corona discharge generating unit 41 from the high voltage power supply 94.

Detailed Description of Electrorheological Ink

Next, the electrorheological ink used in the inkjet recording apparatus 10 will be described with reference to FIG. 7.

In the inkjet recording apparatus 10, the ions 102 radiated from the corona discharge generating unit 41 become applied to the surface of the ink droplet 100 having landed on a print surface (front surface) side 16A of the recording paper 16, thereby charging the surface of the ink droplet 100 to have a positive potential.

Figure 7:
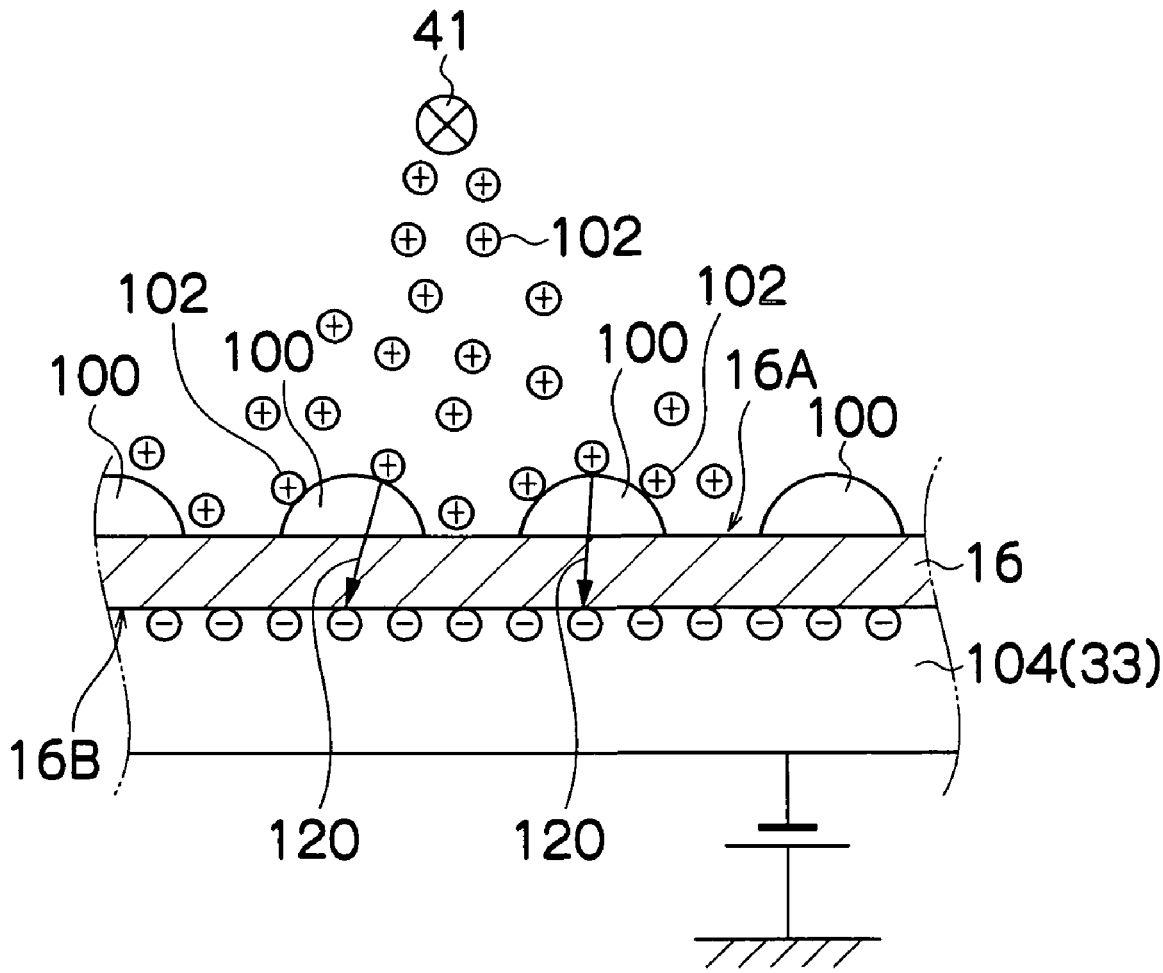
FIG. 7 is a view illustrating the principles of electrorheological ink.

Meanwhile, the lower electrode 104 shown in FIG. 7 is connected to a negative potential, and therefore a belt contact surface (rear surface) side 16B of the recording paper 16 that contacts the belt 33 has a negative potential. As a result, the electric field 120 is formed from the ions 102 to the lower electrode 104 so as to penetrate the ink droplet 100 (a current is generated by the electric field 120).

The electric field 120 shown in FIG. 7 is an outline of the electric field that is generated between the ions 102 and the lower electrode 104. In actuality, a plurality of electric fields are generated for each liquid droplet between the plurality of ions and the lower electrode 104, and a combined electric field of the plurality of electric fields serves as the electric field acting on each liquid droplet.

As described with reference to FIG. 6, an electric field having an intensity between several kV/mm and several tens kV/mm should be applied to the ink droplet to generate the electrorheological effect; however, it is extremely difficult to maintain such a high voltage without the voltage being discharged into the atmosphere.

According to the present embodiment, by generating the electric field required to produce the electrorheological effect between the surface of the ink droplet 100 and the rear surface 16B of the recording paper 16, the electric field intensity (voltage) required to produce the electrorheological effect can be maintained, and hence the electrorheological effect can be produced effectively.

As described with reference to FIG. 2, the rear surface 16B of the recording paper 16 may be set to the reverse potential of the ions applied to the surface of the ink droplet 100 as shown in FIG. 7, or may be set to 0V as shown in FIG. 2.

Moreover, by setting the rear surface 16B of the recording paper 16 to a predetermined reference potential using the lower electrode 104, the electric field can be generated reliably between the surface of the ink droplet 100 and the rear surface 16B of the recording paper 16, and hence the electrorheological effect can be produced reliably.

Furthermore, according to the present embodiment, the electrorheological effect can be generated when a conductive medium such as a thin metallic plate or a medium having a certain thickness is used, even though such media make it difficult to apply an electric field to the ink to produce the electrorheological effect in the medium charging method.

Modified Example

Next, a modified example of the inkjet recording apparatus 10 described above will be described with reference to FIG. 8.

Figure 8:
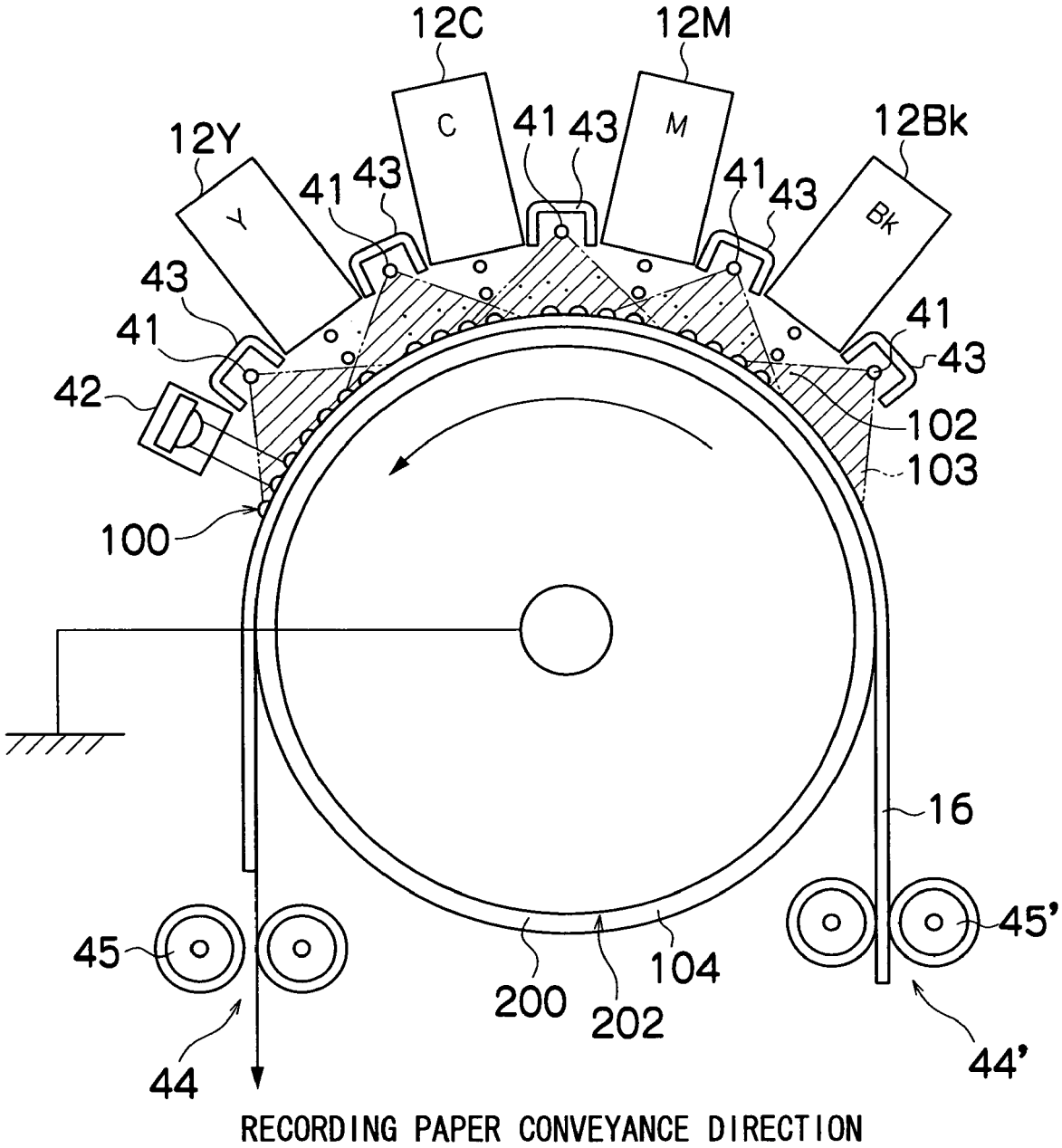
FIG. 8 is a constitutional diagram showing a modified example of the print unit shown in FIG. 2.

FIG. 8 is a general schematic diagram showing the structure of the print unit 12 of the inkjet recording apparatus 10 according to another embodiment of the present invention. In FIG. 8, identical or similar parts to those shown in FIG. 2 are denoted with identical reference numerals, and description thereof is omitted.

In the embodiment shown in FIG. 8, drum conveyance using a drum 200 is employed instead of belt conveyance using the suction belt conveyance unit 22. The lower electrode 104 is provided on a recording paper holding surface 202 of the drum 200, and the lower electrode 104 is set to 0V via the drum 200.

When the drum 200 shown in FIG. 8 is rotated counterclockwise (the direction shown by the arrow in FIG. 8), the recording paper 16 held (by suction, for example) on the drum 200 is conveyed from the print head 12Bk side to the print head 12Y side, and thus a desired image is formed on the recording paper 16 by ink droplets ejected from the print heads 12Bk, 12M, 12C, 12Y.

In order to simplify FIG. 8, the print determination unit 24, which is provided after the ink fixing acceleration unit 42 in FIGS. 1 and 2, is not shown.

In the present embodiment, the corona discharge generating unit 41 is also provided on the upstream side of the print head 12Bk in the recording paper conveyance direction, and hence the ion application area extends further upstream in the recording paper conveyance direction than the printing area of the print head 12Bk.

By means of this constitution, ions can be applied to the ink droplets reliably from the timing at which the ink droplet ejected from the print head 12Bk, located furthest upstream in the recording paper conveyance direction, lands on the recording paper 16.

In order to apply the electric field to the electrorheological ink having landed on the recording paper 16 in the inkjet recording apparatus 10 constituted as described above, the corona discharge generating unit 41 is provided for radiating the ions 102, and the lower electrode 104 is provided to contact the rear surface of the recording paper 16. As a result, the electrorheological effect can be generated effectively, and can even be generated on media such as a conductive medium or a medium having a certain thickness.

Furthermore, the area in which the ions 102 are applied by the corona discharge generating unit 41 (the electric field application area) extends from the ink landing position through the ink fixing position, and hence the ink can be fixed onto the recording paper 16 in such a manner that dot bleeding, dot spread, and landing interference are suppressed.

The lower electrode 104 is constituted by a roller or a belt, and is therefore able to also serve as the recording paper conveyance device. As a result, the apparatus constitution is simplified, enabling a reduction in cost.

In the above-described embodiments, the inkjet recording apparatus which records an image on a recording medium using ink ejected from nozzles provided in a print head is cited; however, the scope of application of the present invention is not limited thereto, and the present invention may be applied widely to liquid ejection apparatuses (dispensers and the like) which deposit liquid (water, processing liquid, resist, etc.) on an ejection receiving medium (a wafer, printed board, and so on).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

an ejection head which ejects a droplet of electrorheological liquid toward an ejection receiving medium;

an electric charge application device which applies electric charge onto a surface of the droplet deposited on a first surface of the ejection receiving medium substantially simultaneously as the droplet lands on the ejection receiving medium; and an electrode which has a surface facing the electric charge application device across the ejection receiving medium and contacting with a second surface of the ejection receiving medium opposite to the first surface thereof, wherein the entire surface of each electrode facing the electric charge application device has the same charge polarity when generating an electrorheological effect on the droplet.

2. The liquid ejection apparatus as defined in claim 1, wherein the electrode has one of a ground potential and a potential having a polarity reverse to the electric charge applied by the electric charge application device.

3. The liquid ejection apparatus as defined in claim 1, further comprising: a conveyance device which conveys the ejection receiving medium in a conveyance direction relatively to the ejection head, wherein the electric charge application device is arranged at least on a downstream side of the ejection head in the conveyance direction.

4. The liquid ejection apparatus as defined in claim 3, further comprising:

a fixing acceleration device which accelerates fixing of the droplet having landed on the ejection receiving medium and is arranged on the downstream side of the ejection head in the conveyance direction, wherein the electric charge application device applies the electric charge onto the surface of the droplet across an extent from an area in which the droplet lands on the ejection receiving medium to an area in which the droplet is subjected to fixing acceleration performed by the fixing acceleration device.

5. The liquid ejection apparatus as defined in claim 4, wherein the electric charge application device continuously applies the electric charge onto the surface of the droplet across the extent from the area in which the droplet lands on the ejection receiving medium to the area in which the droplet is subjected to fixing acceleration performed by the fixing acceleration device.

6. The liquid ejection apparatus as defined in claim 3, wherein the conveyance device comprises a holding device which holds the ejection receiving medium and serves as the electrode.

7. The liquid ejection apparatus as defined in claim 4, wherein the fixing acceleration device accelerates fixing of the droplet having landed on the ejection receiving medium to harden the droplet or cause the droplet to permeate the ejection receiving medium to a degree to prevent image degradation during handling after the fixing acceleration device.

8. The liquid ejection apparatus as defined in claim 1, wherein a drum includes the electrode.

9. The liquid ejection apparatus as defined in claim 1, wherein a belt conveyance unit includes the electrode.

10. The liquid ejection apparatus as defined in claim 1, wherein the electric charge application device is provided on a downstream side of the ejection head in a conveyance direction of the ejection receiving medium.

11. The liquid ejection apparatus as defined in claim 1, wherein the electric charge application device applies the electric charge onto the surface of the droplet on the first surface of the ejection receiving medium substantially simultaneously as the droplet lands on the ejection receiving medium, and continuously applies the electric charge onto the surface of the droplet.

12. A liquid ejection apparatus, comprising:

a plurality of ejection heads which eject droplets of electrorheological liquid toward an ejection receiving medium;

a conveyance device which conveys the ejection receiving medium in a conveyance direction relatively to the ejection heads, a plurality of electric charge application devices which apply electric charge onto a surface of a droplet deposited on a first surface of the ejection receiving medium substantially simultaneously as the droplet lands on the ejection receiving medium, each of the electric charge application devices being arranged adjacently to each of the ejection heads on a downstream side of each of the ejection heads in the conveyance direction; and an electrode which has a surface facing the electric charge application devices across the ejection receiving medium and contacting with a second surface of the ejection receiving medium opposite to the first surface thereof, wherein the entire surface of each electrode facing the electric charge application devices has the same charge polarity when generating an electrorheological effect on the droplet.

13. An electric field application method, comprising the steps of:

depositing a droplet of electrorheological liquid onto an ejection receiving medium from an ejection head;

applying electric charge onto a surface of the droplet deposited on a first surface of the ejection receiving medium substantially simultaneously as the droplet lands on the ejection receiving medium;

forming an electric field between an electrode provided so as to contact with a second surface of the ejection receiving medium opposite to the first surface thereof, and the electric charge on the surface of the droplet having landed on the ejection receiving medium; and generating electrorheological effect on the droplet having landed on the ejection receiving medium, wherein the entire surface of each electrode facing the ejection head has the same charge polarity when generating the electrorheological effect on the droplet.

14. The electric field application method as defined in claim 13, further comprising the step of:

accelerating fixing of the droplet having landed on the ejection receiving medium, wherein the electric charge applying step is performed for an extent from an area in which the droplet lands on the ejection receiving medium to an area in which the droplet is subjected to the fixing accelerating step.

* * * * *